United States Patent [19]

Wilhelm

[11] 4,423,370

[45] Dec. 27, 1983

[54] CIRCUIT CONFIGURATION FOR GENERATING A D-C OUTPUT VOLTAGE INDEPENDENT OF FLUCTUATIONS OF A D-C SUPPLY VOLTAGE

[75] Inventor: Wilhelm Wilhelm, Munich, Fed. Rep. of Germany

[73] Assignee: Siemens Aktiengesellschaft, Berlin and Munich, Fed. Rep. of Germany

[21] Appl. No.: 416,060

[22] Filed: Sep. 8, 1982

[30] Foreign Application Priority Data

Sep. 21, 1981 [DE] Fed. Rep. of Germany ..... 3137451

[51] Int. Cl.[3] ..... G05F 3/20

[52] U.S. Cl. ..... 323/315; 307/297

[58] Field of Search ..... 307/297; 323/315, 316, 323/317

[56] References Cited

U.S. PATENT DOCUMENTS 3,820,007 6/1974 Schilling et al. ..... 307/297 X 3,922,596 11/1975 Cave et al. ..... 323/316

3,927,335 12/1975 Keller et al. ..... 307/297 X

*Primary Examiner*—William M. Shoop

*Attorney, Agent, or Firm*—Herbert L. Lerner; Laurence A. Greenberg

[57] ABSTRACT

Circuit for generating a d-c output voltage being independent of fluctuations of a d-c supply voltage, including a reference voltage circuit connected to a d-c supply voltage source, the reference voltage circuit including a series circuit of a constant-current source and a potenatial shift branch, an inverting amplifier being connected to and addressed by the reference voltage circuit, the inverting amplifier having an output circuit including a combination of a plurality of first resistors and at least one first transistor determining the gain of the inverting amplifier, an output driver supplying the d-c output voltage, the output driver being connected to and addressed by the inverting amplifier and the output driver having an output circuit being connected to the potential shift branch of the reference voltage circuit for driving the potential shift branch, the output driver including an emitter follower stage having an output circuit with a second transistor and a second resistor, a voltage stabilizing circuit having a tap carrying a prestabilized voltage and the voltage stabilizing circuit being connected to the d-c supply voltage source, a third resistor connected between the tap and the at least one first transistor in the output circuit of the inverting amplifier, and a fourth resistor connected between the tap and the second transistor in the emitter follower output circuit of the output driver, the first, second, third and fourth resistors having the same resistance value.

6 Claims, 1 Drawing Figure

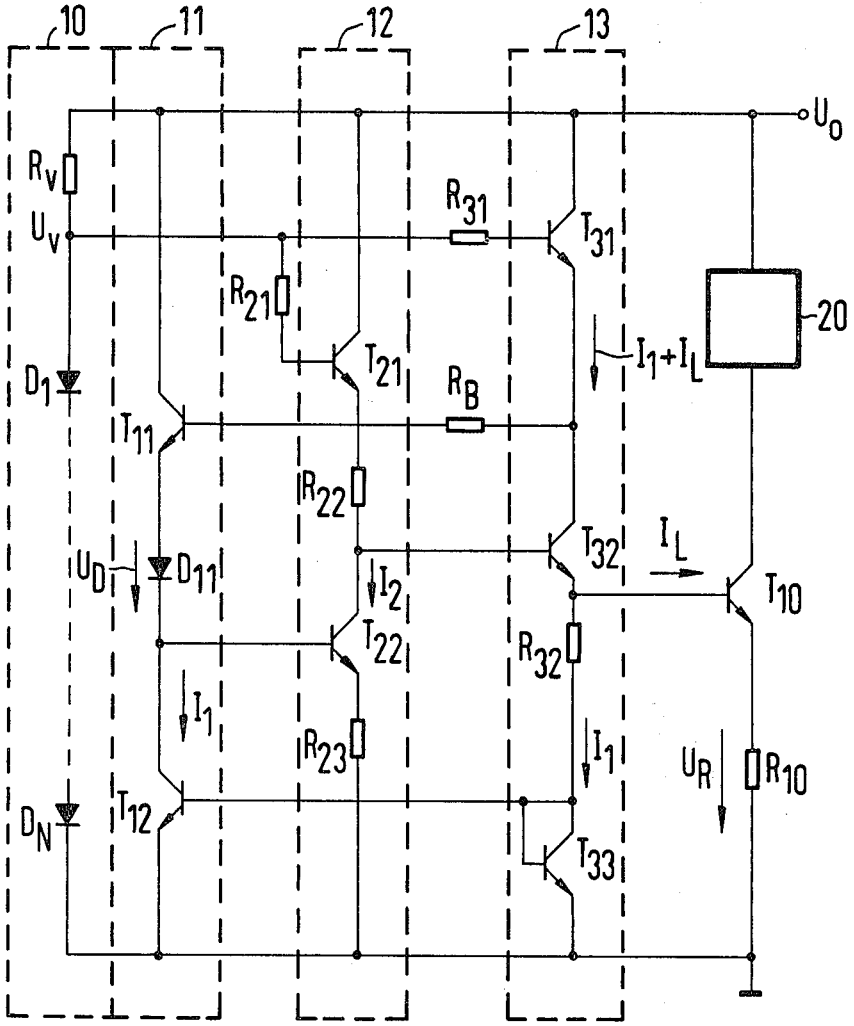
10
11
12
13
$U_0$
$R_V$
$U_V$
$R_{31}$
$T_{31}$
$R_{21}$
20
$T_{21}$
$I_1+I_L$
$D_1$
$R_B$
$T_{11}$
$R_{22}$
$T_{32}$
$I_L$
$U_D$
$D_{11}$
$I_2$
$T_{10}$
$T_{22}$
$R_{32}$
$I_1$
$R_{23}$
$I_1$
$U_R$
$R_{10}$
$D_N$
$T_{12}$
$T_{33}$

CIRCUIT CONFIGURATION FOR GENERATING A D-C OUTPUT VOLTAGE INDEPENDENT OF FLUCTUATIONS OF A D-C SUPPLY VOLTAGE

The invention relates to a circuit arrangement for generating a d-c output voltage which is independent of fluctuations of a d-c supply voltage, especially for addressing current-source transistors for feeding integrated circuits, including a reference voltage circuit connected to the d-c supply voltage in the form of a series circuit of a constant-current source and a potential shift branch, an inverting amplifier being addressed by the reference voltage circuit and having an output circuit with a combination of resistors and at least one transistor which determines its gain, and an output driver which is addressed by the inverting amplifier, which supplies the d-c output voltage, and which has an emitter follower stage and a transistor connected in the output circuit thereof, the output driver addressing the potential shift circuit in the reference voltage circuit.

A circuit configuration of the type mentioned above is known from German Published, Non-Prosecuted Application DE-OS 28 49 153. With such a circuit arrangement, d-c output voltages can be generated which are independent of a d-c supply voltage, where load variations have practically no influence on the d-c output voltage. However, the supply voltage and the temperature range for which independence of the d-c output voltage with respect to the d-c supply voltage applies, is particularly insufficient in many cases. In addition, the current gain of transistors used in the circuit arrangement cannot be compensated in the known circuit arrangement.

It is accordingly an object of the invention to provide a circuit configuration for generating a d-c output voltage which is independent of fluctuations of a d-c supply voltage, which overcomes the hereinafore-mentioned disadvantages of the heretofore-known devices of this general type, and in which the d-c output voltage that is generated is constant over a wide range of supply voltage, temperature, component parameters and particularly current gain of bipolar transistors.

With the foregoing and other objects in view there is provided, in accordance with the invention, a circuit for generating a d-c output voltage being independent of fluctuations of a d-c supply voltage, particularly for addressing current-source transistors for feeding integrable circuits, comprising a reference voltage circuit connected to a d-c supply voltage source, the reference voltage circuit including a series circuit of a constant-current source and a potential shift branch, an inverting amplifier being connected to and addressed by the reference voltage circuit, the inverting amplifier having an output circuit including a combination of a plurality of first resistors and at least one first transistor determining the gain of the inverting amplifier, an output driver supplying the d-c output voltage, the output driver being connected to and addressed by the inverting amplifier and the output driver having an output circuit being connected to the potential shift branch of the reference voltage circuit for driving the potential shift branch, the output driver including an emitter follower stage having an output circuit with a second transistor and a second resistor, a voltage stabilizing circuit having a tap carrying a prestabilized voltage and the voltage stabilizing circuit being connected to the d-c supply voltage source, a third resistor connected between the tap and the at least one first transistor in the output circuit of the inverting amplifier, and a fourth resistor connected between the tap and the second transistor in the emitter follower output circuit of the output driver, the first, second, third and fourth resistors having the same resistance value.

The circuit configuration defined above has the advantage of substantially increasing the range of output voltages by prestabilization; reducing the current drain for large d-c output voltages; substantially reducing the influence of the d-c supply voltage on the d-c output voltage; and keeping the influence of the current gain of the transistors used in the circuit arrangement on the d-c output voltage negligibly small.

In accordance with another feature of the invention, there is provided a fifth resistor being connected between the output circuit of the output driver and the potential shift branch of the reference voltage circuit.

In accordance with a further feature of the invention, the second resistor of the emitter follower stage of the output driver is a working resistor being equal in resistance value to the fifth coupling resistor.

In accordance with an added feature of the invention, the resistance value of the fifth coupling resistor is equal to n-times the resistance value of the second working resistor of the emitter follower stage of the output driver.

In accordance with an additional feature of the invention, the constant-current source includes a third transistor, and the output circuit of the output driver includes a fourth transistor forming a current mirror with the third transistor.

In accordance with a concomitant feature of the invention, the potential shift branch includes a reference diode.

Other features which are considered as characteristic for the invention are set forth in the appended claims.

Although the invention is illustrated and described herein as embodied in a circuit configuration for generating a d-c output voltage independent of fluctuations of a d-c supply voltage, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE of the drawing which is a diagrammatic and schematic circuit diagram of an embodiment of the circuit according to the invention.

Referring now in detail to the single FIGURE of the drawing, it is seen that a voltage stabilizing circuit 10 in the form of a series circuit of a series resistor $R_v$ and a diode chain $D_1$ to $D_N$, is connected to a d-c supply voltage $U_O$ which is subject to fluctuations. Such a voltage stabilizing circuit is known per se in the art. At a tap between the resistor $R_v$ and the diode chain $D_1$ to $D_N$, a prestabilized voltage $U_v$ can be taken off.

A reference voltage circuit 11 is connected to the d-c supply voltage $U_O$. The reference voltage circuit 11 is formed of a voltage divider which is formed by a constant-current source in the form of a transistor $T_{12}$ (optionally with an emitter resistor) and a potential shift branch in the form of the series circuit of a transistor $T_{11}$ and a reference diode $D_{11}$.

The reference voltage circuit 11 addresses an inverting amplifier 12. The inverting amplifier 12 has a gain $-1$, and includes a transistor $T_{22}$, a collector resistor $R_{22}$ and an emitter resistor $R_{23}$. A further resistor $R_{21}$ is inserted into the collector circuit of the transistor $T_{22}$.

The inverting amplifier 12 controls an output driver 13 with a transistor $T_{32}$ connected as an emitter follower. The emitter branch of this transistor $T_{32}$ is connected to a working resistor $R_{32}$ as well as to a transistor $T_{33}$ connected as a diode. The transistor $T_{33}$ together with the transistor $T_{12}$ in the reference voltage circuit 11 forms a current mirror, so that the same current designated with reference symbol $I_1$ flows through these two branches. Connected in the collector branch of the transistor $T_{32}$ is a transistor $T_{31}$, the drive of which will be described in further detail below.

A transistor $T_{10}$ is addressed by the emitter of the transistor $T_{32}$ of the output driver 13. The transistor $T_{10}$, together with an emitter resistor $R_{10}$, serves as a current source transistor for feeding a diagrammatically illustrated load 20. This load 20 can be formed, for instance, by an integrated circuit.

It should be pointed out that several current-source transistors similar to the transistor $T_{10}$ may be connected to the output of the driver 13 at the emitter of the transistor $T_{32}$. Such transistors are driven in parallel by a current $I_L$. The output d-c voltage $U_R$ which is independent of fluctuations of the supply voltage $U_O$, is present at the resistor $R_{10}$. In order to obtain a d-c output voltage $U_R$ which is independent over a wide range of the d-c supply voltage and the component parameters, the transistor $T_{21}$ in the inverting amplifier 12 is addressed through a resistor $R_{21}$, and the transistor $T_{31}$ in the output driver 13, is addressed through a resistor $R_{31}$ by the tap of the voltage stabilizing circuit, at which the prestabilized voltage $U_v$ is present. The coupling via the resistor $R_{21}$ further improves the amplification in the direction toward a more accurate setting of the gain $-1$ of the inverting amplifier.

The transistor $T_{11}$ in the reference voltage circuit 11 is furthermore addressed through a resistor $R_B$ from the junction point of the transistors $T_{31}$ and $T_{32}$ in the output driver 13.

The current flowing through the transistors $T_{31}$ and $T_{32}$ in the output driver 13 is designated with reference symbols $I_1+I_L$. The current flowing through the transistor $T_{22}$ in the inverting amplifier is further designated with reference symbol $I_2$. The voltage $U_D$ is assumed to drop at the reference diode $D_{11}$.

For determining the d-c output voltage $U_R$, the following two circuits or loops in the overall circuit will be considered in further detail.

The first circuit extends from the tap of the voltage stabilizing circuit 10 carrying the voltage $U_v$ through the resistor $R_{21}$, the transistor $T_{21}$, the resistor $R_{22}$, the transistor $T_{32}$, the transistor $T_{10}$ and the resistor $R_{10}$.

The second circuit extends from the tap carrying the voltage $U_v$ through the resistor $R_{31}$, the transistor $T_{31}$, the resistor $R_B$, the transistor $T_{11}$, the diode $D_{11}$, the transistor $T_{22}$ and the resistor $R_{23}$.

Under the assumption that in accordance with the invention the resistors $R_{21}$, $R_{22}$, $R_{23}$ and $R_{31}$ have the same resistance value, the following equations are obtained for the two above-mentioned circuits if base currents of the second order are ignored:

$$U_v = R_{21}I_2/\beta + U_{BE(21)} + R_{22}I_2 + R_{22}(I_1 + I_2)/\beta + U_{BE(32)} + U_{BE(10)} + U_R \quad (1)$$

-continued $$= RI_2/\beta + U_{BE(21)} + RI_2 + R(I_1 + I_2)/\beta + U_{BE(32)} + U_{BE(10)} + U_R$$

$$U_v = R_{31}(I_1 + I_2)/\beta + U_{BE(31)} + R_BI_1/\beta + U_{BE(11)} + U_D + U_{BE(22)} + R_{23}(I_2 + I_2/\beta) \quad (2)$$

$$= R(I_1 + I_2)/\beta + U_{BE(31)} + R_BI_1/\beta + U_{BE(11)} + U_D + U_{BE(22)} + R(I_2 + I_2/\beta)$$

In these equations, the subscripts BE with a particular numeral refer to the base-emitter voltage of the corresponding transistors and $\beta$ refers to their current gain.

If it is taken into consideration that the same voltage drop occurs across the base-emitter paths through which an equal current flows, the following is obtained from equations (1) and (2)

$$U_R = U_D + R_BI_1/\beta \quad (3).$$

It can be seen from the above equation (3) that the d-c output voltage $U_R$ is independent of the voltage $U_v$ and the current $I_L$ flowing through the load circuit, and it is therefore independent of the d-c supply voltage $U_O$ and the load 20.

By means of the resistor $R_B$, the current loss between the emitter and the collector current of the transistor $T_{10}$ can be equalized if $R_B=R_{32}$. If $R_B=n\cdot R_{32}$, the $\alpha$ factors of further $n-1$ transistors can be compensated corresponding to the transistor $T_{10}$ in the active part of the circuit.

The voltage drops occuring across the resistors of the active part of the circuit are proportional to the voltage $U_D$. With the same proportionality factor, the temperature response of the diode $D_{11}$ and the voltage $U_D$, respectively, is also transmitted. This is desirable in many cases, because voltages at resistors and diodes thereby show the same temperature behavior, and therefore differential signals in the circuits are free of temperature influences.

In some cases, however, a temperature response of the diodes is undesirable.

In such cases, the diode $D_{11}$ can be replaced by a circuit supplying a temperature-stable reference voltage, such as is known in principle from "IEEE Journal of Solid-State Circuits", SC-7 (1972), Pages 267 to 269.

The foregoing is a description corresponding to German application No. P 31 37 451.4, dated Sept. 21, 1981, the International priority of which is being claimed for the instant application, and which is hereby made part of this application. Any discrepancies between the foregoing specification and the aforementioned corresponding German application are to be resolved in favor of the latter.

I claim:

1. Circuit for generating a d-c output voltage being independent of fluctuations of a d-c supply voltage, comprising a reference voltage circuit connected to a d-c supply voltage source, said reference voltage circuit including a series circuit of a constant-current source and a potential shift branch, an inverting amplifier being connected to and addressed by said reference voltage circuit, said inverting amplifier having an output circuit including a combination of a plurality of first resistors and at least one first transistor determining the gain of said inverting amplifier, an output driver supplying said d-c output voltage, said output driver being connected to and addressed by said inverting amplifier and said output driver having an output circuit being connected to said potential shift branch of said reference voltage circuit for driving said potential shift branch, said output driver including an emitter follower stage having an output circuit with a second transistor and a second resistor, a voltage stabilizing circuit having a tap carrying a prestabilized voltage and said voltage stabilizing circuit being connected to the d-c supply voltage source, a third resistor connected between said tap and said at least one first transistor in said output circuit of said inverting amplifier, and a fourth resistor connected between said tap and said second transistor in said emitter follower output circuit of said output driver, said first, second, third and fourth resistors having the same resistance value.

2. Circuit according to claim 1, including a fifth resistor being connected between said output circuit of said output driver and said potential shift branch of said reference voltage circuit.

3. Circuit according to claim 2, wherein said second resistor of said emitter follower stage of said output driver is equal in resistance value to said fifth resistor.

4. Circuit according to claim 2, wherein the resistance value of said fifth resistor is equal to n-times the resistance value of said second resistor of said emitter follower stage of said output driver.

5. Circuit according to claim 1, wherein said constant-current source includes a third transistor, and said output circuit of said output driver includes a fourth transistor forming a current mirror with said third transistor.

6. Circuit according to claim 1, wherein said potential shift branch includes a reference diode.

* * * * *